US008292652B2

(12) United States Patent
Rohde et al.

(10) Patent No.: US 8,292,652 B2
(45) Date of Patent: Oct. 23, 2012

(54) ELECTRICAL CONNECTOR HAVING A LATCH LOCK

(75) Inventors: Carl William Rohde, Elizabethtown, PA (US); Cary Jay Rohler, Lewisberry, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 273 days.

(21) Appl. No.: 12/752,588

(22) Filed: Apr. 1, 2010

(65) Prior Publication Data

US 2011/0244706 A1 Oct. 6, 2011

(51) Int. Cl.
*H01R 13/62* (2006.01)

(52) U.S. Cl. ..... 439/352

(58) Field of Classification Search ..... 439/352, 439/357, 489, 752

See application file for complete search history.

(56) References Cited

U.S. PATENT DOCUMENTS 5,556,295 A 9/1996 McFadden et al.
5,681,178 A * 10/1997 Kunkle et al. ..... 439/352
5,848,912 A * 12/1998 Okabe ..... 439/489
5,863,214 A 1/1999 Hanak
6,186,819 B1 2/2001 Holub
6,450,830 B1 * 9/2002 Koseki ..... 439/352
6,780,045 B2 * 8/2004 Hall et al. ..... 439/489
7,192,307 B1 3/2007 Tran et al.
7,371,097 B1 5/2008 Pennypacker et al.
7,384,285 B2 6/2008 Pattterson et al.
7,399,195 B2 * 7/2008 Kim et al. ..... 439/352
7,476,123 B2 * 1/2009 Kobayashi et al. ..... 439/489
7,559,778 B2 7/2009 Pittenger et al.
7,682,181 B1 * 3/2010 Jones et al. ..... 439/352
2002/0052135 A1 * 5/2002 Noguchi et al. ..... 439/352
2004/0023547 A1 * 2/2004 Oka ..... 439/352
2004/0067676 A1 * 4/2004 Nimura ..... 439/352

* cited by examiner

*Primary Examiner* — Tho D Ta

(57) ABSTRACT

An electrical connector includes a housing holding a contact configured for mating with a mating connector. The housing has a deflectable latch configured for latching engagement with the mating connector. The latch is movable from a resting position to an actuated position. The electrical connector also includes a latch lock separate and discrete from the housing. The latch lock being coupled to the housing such that the latch lock blocks the latch from moving from the resting position to the actuated position.

20 Claims, 4 Drawing Sheets

ELECTRICAL CONNECTOR HAVING A LATCH LOCK

BACKGROUND OF THE INVENTION

The subject matter herein relates generally to electrical connectors, and more particularly, to electrical connectors having a latch lock.

In certain applications, electrical connectors must be securely mated to one another to prevent disconnection of the electrical signals routed through the connector conductors. Some examples of applications for electrical connectors having a need for additional connector retention include household or industrial appliances, automotive connectors, garage door openers, power supplies, power connections, and the like. Such electrical connectors may be subject to inadvertent disconnection of the electrical signals as a result of accident, operating conditions such as vibration, and the like which may result in undesirable consequences. Thus, some electrical connectors are coupled to connector assemblies that mechanically latch the electrical connectors in mating engagement with one another.

Some conventional connector assemblies include a plug connector and a receptacle connector, both having housings holding one or more connector conductors. The plug and receptacle connectors include latches that engage one another to provide greater retention than non-latching type connectors, which could vibrate apart or otherwise become inadvertently disconnected. However, such latching type connectors may still be susceptible to inadvertent disconnection. For example, the latches may become unlatched accidentally, such as when a user or another object presses against one of the latches, thus unlatching the latches. The latches may not be completely latched during mating of the plug and receptacle connectors, which would allow the plug and receptacle connectors to become disconnected.

A need remains for a system that ensures initial latching between latches of electrical connectors. A need remains for a system that ensures continuous latching between latches of electrical connectors.

BRIEF DESCRIPTION OF THE INVENTION

In one embodiment, an electrical connector is provided including a housing holding a contact configured for mating with a mating connector. The housing has a deflectable latch configured for latching engagement with the mating connector. The latch is movable from a resting position to an actuated position. The electrical connector also includes a latch lock separate and discrete from the housing. The latch lock being coupled to the housing such that the latch lock blocks the latch from moving from the resting position to the actuated position.

Optionally, the latch lock may be coupled to the latch. The latch lock may be removably coupled to the housing, with the latch being movable from the resting position to the actuated position when the latch lock is removed from the housing, and with the latch being blocked from moving to the resting position to the actuated position when the latch lock is coupled to the housing. Optionally, the housing may include an outer wall with the latch extending from the outer wall. The latch lock may be coupled to the housing such that the latch lock is positioned between the outer wall and the latch. The latch may include a cap and a stem supporting the cap, where the stem extends from an outer wall of the housing. The cap may be pivoted about the stem between the resting position and the actuated position, and the latch lock may be coupled to an end of the cap such that a base of the latch lock is positioned between the cap and the outer wall.

Optionally, the latch may include a base and a hook with the base being positioned between the latch and the housing, and with the hook being coupled to the latch to secure the latch lock in position with respect to the latch. The hook may extend from the base and form a cavity between the base and the hook that receives an actuating end of the latch such that the base is inward of the actuating end and the hook is outward of the actuating end. The hook may include a finger wrapping around a lip of the latch to securely couple the hook to the latch. The hook may have an end wall and a finger extending from the end wall generally parallel to the base, with the finger having a catch surface spaced apart from, and facing, the end wall. The end wall may have a protrusion extending therefrom, with the latch being captured between the protrusion and the catch surface. The base may include a guide rib extending therefrom that is received in a guide slot in the housing to position the latch lock with respect to the housing. The base may have an inner surface and an outer surface angled with respect to the inner surface such that the outer surface is non-parallel with respect to the inner surface defining a wedge portion of the base. The latch lock may be coupled to the housing such that the inner surface engages the housing and the outer surface engages the latch.

In another embodiment, a latch lock is provided for a latch of an electrical connector. The latch lock includes a base configured to be positioned between the latch and a housing of the electrical connector to block movement of the latch toward the housing. The latch lock also includes a hook extending from the base. The hook is configured to wrap around an end of the latch to secure the latch lock to the latch, and the hook is removable from the latch.

DETAILED DESCRIPTION OF THE INVENTION

Figure 1:
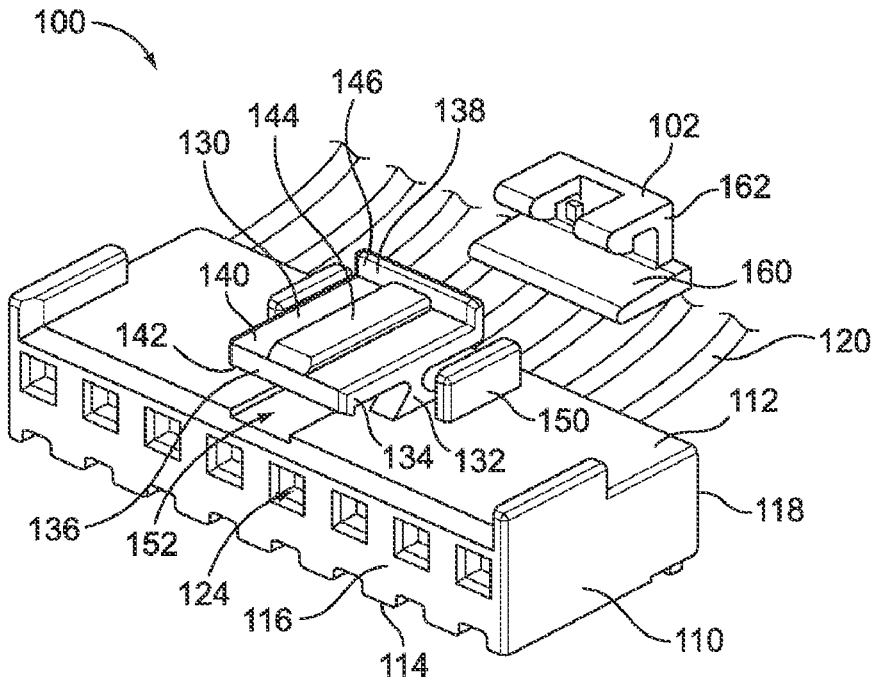
FIG. 1 is a front perspective view of an electrical connector and latch lock for the electrical connector.
Figure 2:
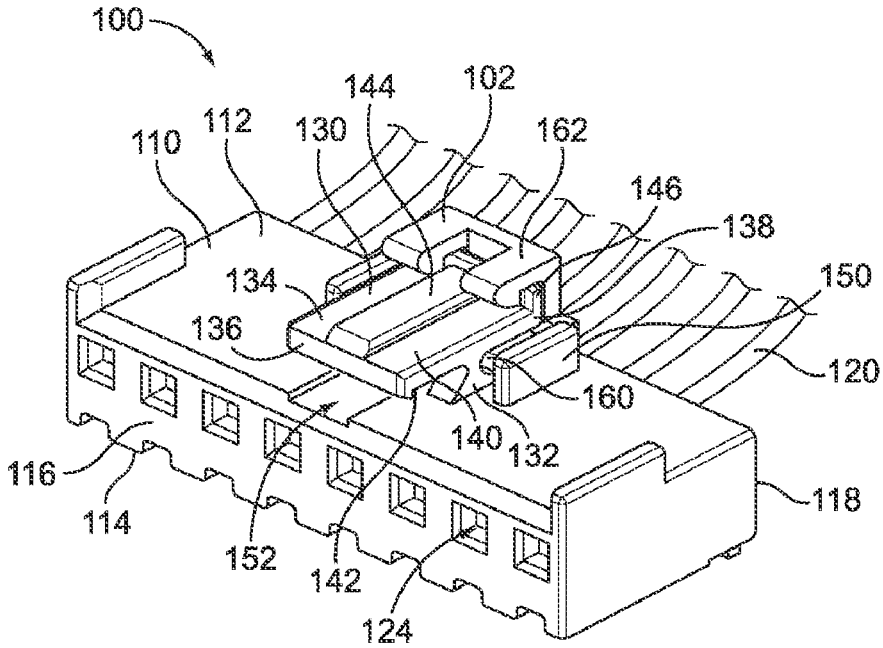
FIG. 2 illustrates the latch lock coupled to the electrical connector.

FIG. 1 is a front perspective view of an electrical connector 100 and latch lock 102 for the electrical connector 100. FIG. 2 illustrates the latch lock 102 coupled to the electrical connector 100. In the illustrated embodiment, the electrical connector 100 is an Economy Power Connector, commercially available from Tyco Electronics, which forms part of a wire-to-board connector system when mated to a mating connector 104 (shown in FIG. 3). However, the subject matter herein is not intended to be limited to an Economy Power Connector, but rather the Economy Power Connector is merely illustrative of one exemplary type of connector that may utilize a latch locking system as described herein.

The electrical connector 100 includes a housing 110 having a top outer wall 112, a bottom outer wall 114, a mating end 116 at a front of the electrical connector 100 and a wire end 118 at a rear of the electrical connector 100. The mating end 116 is configured for mating engagement with the mating connector 104. Wires 120 having contacts 122 (shown in FIG. 3) terminated to the ends thereof are loaded into contact channels 124 of the housing 110. The contacts 122 are held in the contact channels 124 for mating engagement with the mating connector 104. The contact channels 124 are open at the mating end 116 to provide access to the contact channels 124. Any number of contact channels 124 may be provided depending on the particular application.

The electrical connector 100 includes a deflectable latch 130 extending from the top outer wall 112 of the housing 110. The latch 130 is integrally formed with the housing 110, however, the latch 130 may be separately provided from, and coupled to, the housing 110 in alternative embodiments. The latch 130 is used to securely couple the electrical connector 100 to the mating connector 104. The latch 130 is movable between a resting position and an actuated position, such as by pressing on the latch 130 to pivot the latch 130 between the positions. The latch lock 102 is configured to be coupled to the latch 130 and/or the housing 110 to block the latch 130 from being deflected from the resting position to the actuated position.

The latch 130 includes a stem 132 and a cap 134 extending from the stem 132. The stem 132 is coupled to the top outer wall 112 of the housing 110 and extends generally perpendicular with respect to the top outer wall 112. The stem 132 may be substantially centered with respect to the cap 134 between a latching end 136 and an actuating end 138 of the cap 134. The cap 134 may be pivoted about the stem 132 between the resting position and the actuated position, such as by pressing on the actuating end 138. The latching end 136 is configured to engage the mating connector 104 to securely couple the electrical connector 100 to the mating connector 104. The actuating end 138 is configured to be pressed or otherwise moved by the operator to actuate the latch 130 from the resting position to the actuated position.

The cap 134 includes a top surface 140 and a bottom surface 142 that faces the top outer wall 112 of the housing 110. The top and bottom surfaces 140, 142 are generally parallel to the top outer wall 112 of the housing 110. A rail 144 extends along the top surface 140 generally between the latching end 136 and the actuating end 138. The rail 144 may provide rigidity or strength to the latch 130. In an exemplary embodiment, a lip 146 is provided at the actuating end 138. The lip 146 extends perpendicular to the top surface 140. The lip 146 provides a surface for the operator to press against during actuation of the latch 130. The lip 146 also provides a surface for the latch lock 102 to engage to securely couple the latch lock 102 to the latch 130.

The housing 110 includes flanges 150 extending from the top outer wall 112 proximate to the latch 130. The flanges 150 may provide overstress protection for the latch 130 by blocking or limiting downward pressure on the latch by the operator. For example, when the operator's finger engages the flanges 150, the downward pressing by the operator stops. The flanges 150 may prevent objects, such as wires, from getting caught underneath the latch 130, such as in the space between the bottom surface 142 and the top outer wall 112.

The housing 110 includes a guide slot 152 in the top outer wall 112. The guide slot 152 may receive a portion of the mating connector 104 to properly align the electrical connector 100 with the mating connector 104 during mating. The guide slot 152 may receive a portion of the latch lock 102 to properly align the latch lock 102 with the electrical connector 100 when the latch lock 102 is coupled to the latch 130 and/or the housing 110.

The latch lock 102 includes a base 160 and a hook 162 extending from the base 160. The latch lock 102 is separate and discrete from the housing 110 and the latch 130. The latch lock 102 is removably coupled to the latch 130 and/or the housing 110 to lock the latch 130 in the resting position and block the latch 130 from moving to the actuated position. During mating with the latch 130 and/or the housing 110, the base 160 is received in the space between the bottom surface 142 and the top outer wall 112. The base 160 blocks movement of the actuating end 138 toward the top outer wall 112, and as such, blocks actuation of the latch 130 when the latch lock 102 is coupled thereto. The hook 162 is configured to be coupled to the latch 130. In an exemplary embodiment, the hook 162 wraps around the actuating end 138 of the latch 130 and is secured to the lip 146. The latch lock 102 is removable from the latch 130, such as by deflecting the hook 162 outward and then pulling the latch lock 102 away from the latch 130. Once removed, the latch 130 is able to be actuated from the resting position to the actuated position.

Figure 3:
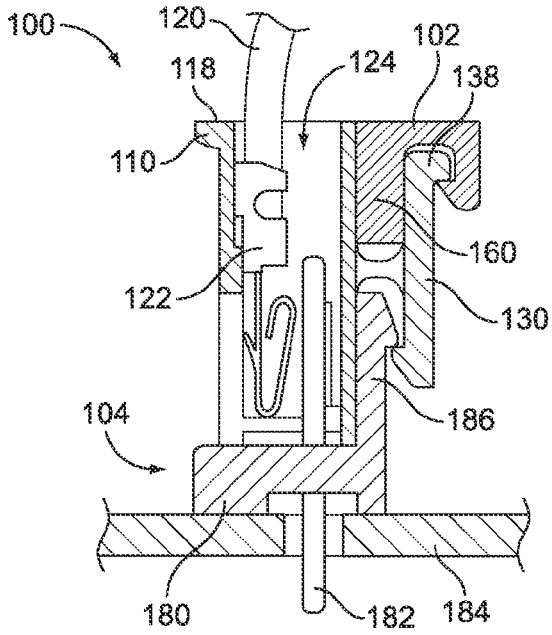
FIG. 3 is a cross-sectional view of the electrical connector coupled to a mating connector.

FIG. 3 is a cross-sectional view of the electrical connector 100 coupled to a mating connector 104. The mating connector 104 includes a housing 180 holding mating contacts 182 therein. The mating contacts 182 are configured to be terminated to a circuit board 184, such as by press-fit mounting or through-hole mounting to plated vias of the circuit board 184 or surface mounting to pads on the circuit board 184. The housing 180 rests on a surface of the circuit board 184.

The contacts 122 are loaded into the contact channels 124 and are positioned for engagement with the mating contacts 182. In the illustrated embodiment, the contacts 122 represent sockets and the mating contacts 182 represent pins, however other types of contacts 122 and mating contacts 182 may be used in alternative embodiments. The wires 120 are terminated to the contacts 122, such as by a crimped connection, however other types of connections may be used, such as insulation displacement connections. The wires 120 extend from the wire end 118 of the housing 110.

The latch 130 is coupled to a latch 186 of the mating connector 104, and is shown in a latched position. In the latched position, the latches 130, 186 include surfaces that engage one another and resist disconnection of the electrical connector 100 from the mating connector 104. The latch 130 is in the resting position when secured to the latch 186 of the mating connector 104. In operation, when the latch 130 is deflected to the actuated position, the latch 130 may be cleared past the latch 186 so that the electrical connector 100 may be removed from mating engagement with the mating connector 104. The latch lock 102 is positioned with respect to the latch 130 to block the latch 130 from moving to the actuated position. As such, until the latch lock 102 is removed from the latch 130, the latch 130 is locked in the latched position with respect to the latch 186.

When the latch lock 102 is coupled to the latch 130 and/or the housing 110, the latch 130 cannot be removed from the latch 186 without first removing the latch lock 102. The latch lock 102 thus ensures continuous latching between the latches 130, 186 during use of the connector system. Additionally, in an exemplary embodiment, the latch lock 102 may not be mated to the latch 130 when the latch 130 is not in a resting position. For example, during mating of the electrical connector 100 to the mating connector 104, the latch 130 may be automatically moved outward toward the actuated position by the interaction between the ramped surfaces of the latches 130, 186. In such case, the actuating end 138 may be forced toward the housing 110, effectively closing off the space between the latch 130 and the housing 110 that is configured to receive the base 160 of the latch lock 102. In such position, the latch lock 102 may not be inserted into the space because there is not adequate clearance between the latch 130 and housing 110. As such, until the electrical connector 100 is fully mated onto the mating connector 104, the latch 130 is unable to be oriented in the resting position, and thus, the latch lock 102 cannot be coupled to the latch 130. The lock latch 102 thus ensures initial latching between latches 130, 186 by not allowing assembly of the latch lock 102 until the latches 130, 186 are fully mated.

Figure 4:
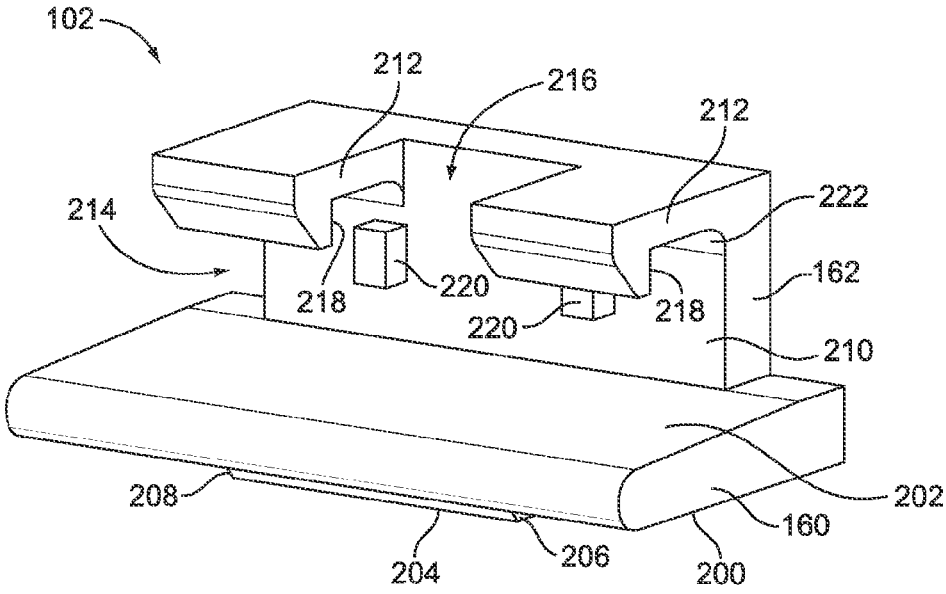
FIG. 4 is a front perspective view of the latch lock shown in FIG. 1.
Figure 5:
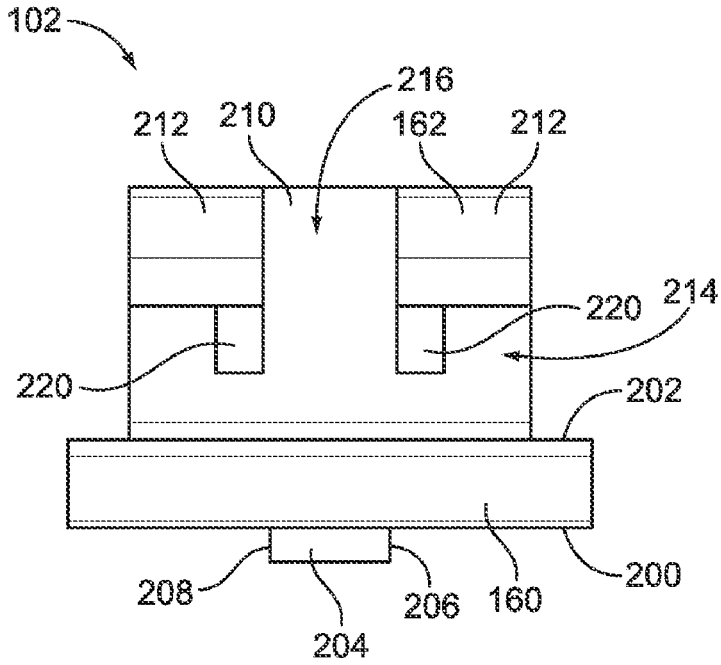
FIG. 5 is a front view of the latch lock shown in FIG. 4.
Figure 6:
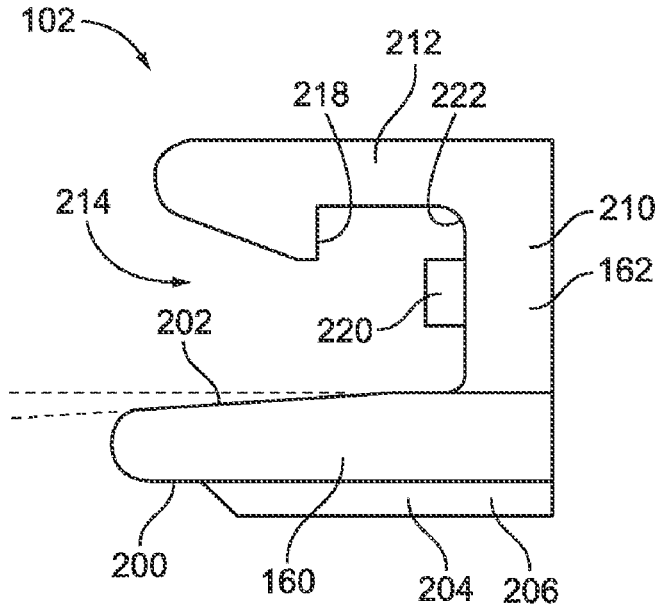
FIG. 6 is a side view of the latch lock shown in FIG. 4.

FIG. 4 is a front perspective view of the latch lock 102. FIGS. 5 and 6 are front and side views, respectively, of the latch lock 102. The latch lock 102 includes the base 160 and the hook 162, which extends from the base 160.

The base 160 includes an inner surface 200 and an outer surface 202. The outer surface 202 is angled with respect to the inner surface 200 such that the outer surface 202 is non-parallel with respect to the inner surface 200. Optionally, the outer surface 202 may be angled at approximately a 5° angle, however other angles are possible in alternative embodiments. The inner surface 200 may additionally, or alternatively, be angled. The angled nature of the inner and outer surfaces 200, 202 defines a wedge portion of the base 160 with a narrower front end and a wider rear end. When the base 160 is loaded into the space between the latch 130 and the housing 110 (both shown in FIGS. 1-3), the inner surface 200 engages the housing 110 and the outer surface 202 engages the latch 130. The wedge shape of the base 160 forces the actuating end 138 (shown in FIGS. 1 and 2) of the latch 130 outward away from the housing 110, which presses the latching end 136 (shown in FIGS. 1 and 2) toward the latch 186 (shown in FIG. 3). As such, the base 160 is used to maintain the latch 130 in the latched position and resists inadvertent or accidental unlatching. Having the front of the base 160 narrower also helps when loading the latch lock 102 into the space between the latch 130 and the housing 110 by allowing additional clearance when initially aligning the latch lock 102 into position. In an alternative embodiment, rather than having the inner and outer surfaces 200, 202 angled with respect to one another, the inner and outer surfaces 200, 202 may be parallel to one another.

In an exemplary embodiment, the base 160 includes a guide rib 204 extending therefrom. The guide rib 204 is configured to be received in the guide slot 152 (shown in FIGS. 1 and 2) in the housing 110 to position the latch lock 102 with respect to the housing 110. The guide rib 204 includes side walls 206, 208 that engage corresponding walls defining the guide slot 152 to hold the side-to-side position of the latch lock 102 with respect to the housing 110. The interaction between the guide rib 204 and the guide slot 152 also properly aligns the hook 162 for mating with the latch 130.

The hook 162 includes an end wall 210 extending perpendicularly with respect to the base 160 and fingers 212 extending from the end wall 210. Optionally, the fingers 212 may extend from the end wall 210 generally parallel to the base 160. The base 160, end wall 210 and fingers 212 define a cavity 214 that receives the actuating end 138 of the latch 130. The base 160, end wall 210 and fingers 212 may be C-shaped around the cavity 214. When the actuating end 138 is received in the cavity 214, the base 160 is inward of the actuating end 138 and the fingers 212 of the hook 162 are outward of the actuating end 138. The fingers 212 are configured to wrap around the lip 146 (shown in FIGS. 1 and 2) of the latch 130 to securely couple the hook 162 to the latch 130. The fingers 212 are spaced apart from one another to form a gap 216 that is configured to receive the rail 144 (shown in FIGS. 1 and 2) of the latch 130. As such, the fingers 212 are positioned on opposite sides of the rail 144, and the rail 144 may be used to locate the latch lock 102 with respect to the latch 130. The fingers 212 have catch surfaces 218 spaced apart from, and facing, the end wall 210. The catch surfaces 218 are configured to engage the lip 146 to couple the hook 162 to the latch 130.

In an exemplary embodiment, the end wall 210 has one or more protrusions 220 extending therefrom. The protrusions 220 are configured to engage the outer edge of the actuating end 138 of the latch 130 to locate the latch lock 102 with respect to the latch 130. The protrusions 220 are spaced apart from the catch surfaces 218 by a predetermined distance that is substantially equal to a thickness of the lip 146 such that the lip 146 may be captured between the protrusions 220 and the catch surfaces 218. The protrusions 220 space the latch 130 apart from the end wall 210, which may accommodate radiused transitions 222 between the base 160 and the end wall 210 and/or between the end wall 210 and the fingers 212. The radiused transitions 222 may be easier and more cost effective to manufacture than right angle transitions.

Figure 7:
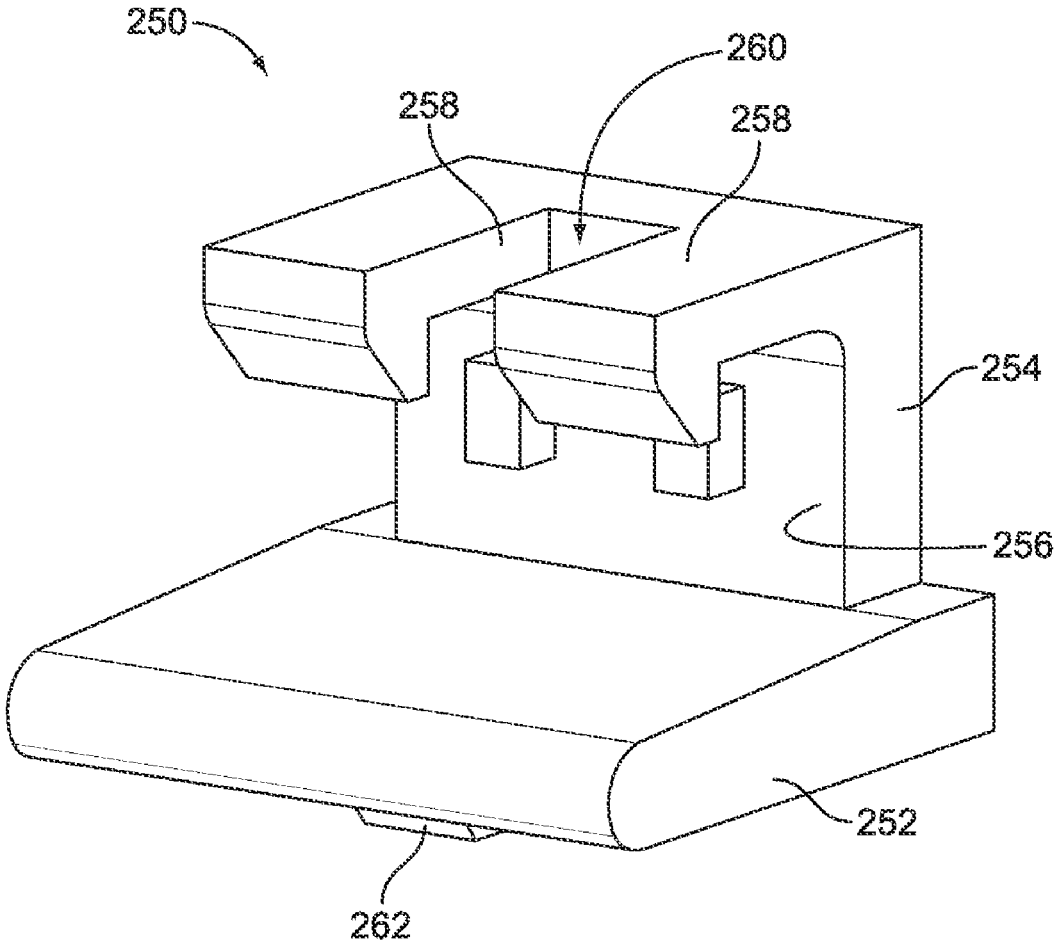
FIG. 7 is a front perspective view of an alternative latch lock.

FIG. 7 is a front perspective view of an alternative latch lock 250. The latch lock 250 is similar to the latch lock 102 (shown in FIGS. 1-6), however the latch lock 250 is narrower than the latch lock 102. The latch lock 250 may be used on an electrical connector that has a narrower latch. For example, electrical connectors having a small number of contact channels and contact positions (e.g. 3 positions or less) may have a narrower latch, and the latch lock 250 may be better suited for such latches.

The latch lock 250 includes a base 252 and a hook 254 having an end wall 256 and fingers 258 extending from the end wall 256. The fingers 258 are spaced apart by a gap 260 that is narrower than the gap 216 (shown in FIG. 5). The gap 260 receives a rail that is narrower than the rail 144 (shown in FIGS. 1 and 2). The base 252 includes a guide rib 262 that is narrower than the guide rib 204 (shown in FIGS. 4-6). The guide rib 262 is configured to be received in a guide slot that is narrower than the guide slot 152 (shown in FIGS. 1 and 2).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing holding a contact configured for mating with a mating connector, the housing having a deflectable latch configured for latching engagement with the mating connector, the latch being movable from a resting position to an actuated position; and a latch lock separate and discrete from the housing, the latch lock being coupled to the housing such that the latch lock blocks the latch from moving from the resting position to the actuated position, wherein the latch lock is couplable to the housing prior to the latching engagement of the latch with the mating connector and wherein the latch lock is couplable to the housing after the latching engagement of the latch with the mating connector.

2. The electrical connector of claim 1, wherein the latch lock is removably coupled to the latch both prior to the latching engagement of the latch with the mating connector and after the latching engagement of the latch with the mating connector.

3. The electrical connector of claim 1, wherein the latch lock is removably coupled to the housing, the latch being movable from the resting position to the actuated position when the latch lock is removed from the housing, the latch being blocked from moving from the resting position to the actuated position when the latch lock is coupled to the housing.

4. The electrical connector of claim 1, wherein the housing includes an outer wall, the latch extending from the outer wall, the latch lock being coupled to the housing such that the latch lock is positioned between the outer wall and the latch.

5. The electrical connector of claim 1, wherein the latch lock includes a base and a hook, the base being positioned between the latch and the housing, the hook being coupled to the latch to secure the latch lock in position with respect to the latch.

6. The electrical connector of claim 1, wherein the latch includes a cap and a stem supporting the cap, the stem extending from an outer wall of the housing, the cap being pivoted about the stem between the resting position and the actuated position, the latch lock being coupled to an end of the cap such that a base of the latch lock is positioned between the cap and the outer wall.

7. The electrical connector of claim 1, wherein the latch includes a latching end and an actuating end, the latching end being configured to engage the mating connector, the actuating end being pressed toward the housing to move the latching end to the actuated position, the latch lock being coupled to the actuating end to block the actuating end from being pressed toward the housing.

8. The electrical connector of claim 1, wherein the latch lock includes a base and a hook extending from the base and forming a cavity between the base and the hook, the cavity receives an actuating end of the latch such that the base is inward of the actuating end and the hook is outward of the actuating end.

9. The electrical connector of claim 1, wherein the latch lock includes a base and a hook extending from the base, the hook includes a finger wrapping around a lip of the latch to securely couple the hook to the latch.

10. The electrical connector of claim 1, wherein the latch lock includes a base and a hook extending from the base, the hook having an end wall and a finger extending from the end wall generally parallel to the base, the finger having a catch surface spaced apart from, and facing, the end wall, the end wall having a protrusion extending therefrom toward the catch surface, the protrusion being spaced apart from the catch surface by a predetermined amount, wherein the latch is captured between the protrusion and the catch surface such that the latch is spaced apart from the end wall.

11. The electrical connector of claim 1, wherein the latch lock includes a base and a hook extending upward from the base, the base having a guide rib extending therefrom in a downward direction generally opposite the hook, the guide rib being received in a guide slot in the housing to position the latch lock with respect to the housing.

12. The electrical connector of claim 1, wherein the latch lock includes a base and a hook extending from the base, the base having an inner surface and an outer surface, the outer surface being angled with respect to the inner surface such that the outer surface is non-parallel with respect to the inner surface defining a wedge portion of the base, the latch lock being coupled to the housing such that the inner surface engages the housing and the outer surface engages the latch.

13. A latch lock for a latch of an electrical connector, the latch lock comprising:

a base configured to be positioned between the latch and a housing of the electrical connector to block movement of the latch toward the housing; and a hook extending from the base, the hook being configured to wrap around an end of the latch to secure the latch lock to the latch, wherein the hook includes an end wall and a finger extending from the end wall generally parallel to the base, the finger having a catch surface spaced apart from, and facing, the end wall, the end wall having a protrusion extending therefrom toward the catch surface, wherein the protrusion and the catch surface are configured to capture the latch therebetween such that the latch is spaced apart from the end waif, the hook being removable from the latch.

14. The latch lock of claim 13, wherein the hook extends from the base to form a cavity, the cavity being configured to receive an actuating end of the latch such that the base is inward of the actuating end and the hook is outward of the actuating end.

15. The latch lock of claim 13, wherein the hook and base cooperate to form a C-shaped body defining a cavity, the cavity being configured to receive an actuating end of the latch.

16. The latch lock of claim 13, wherein the hook includes a finger configured to wrap around the latch, the finger having a catch surface configured to engage and securely couple the hook to the latch.

17. The latch lock of claim 13, wherein the hook includes an end wall and a finger extending from the end wall generally parallel to the base, the finger having a catch surface spaced apart from, and facing, the end wall, the end wall having a protrusion extending therefrom, wherein the protrusion and the catch surface are configured to capture the latch therebetween.

18. The latch lock of claim 13, wherein the hook includes an end wall extending from the base and fingers extending from the end wall generally parallel to the base, the fingers being spaced apart from one another to form a gap, the gap being configured to receive a rail of the latch.

19. The latch lock of claim 13, wherein the base includes a guide rib extending therefrom in a direction generally opposite of the hook, the guide rib being configured to be received in a guide slot in the housing of the electrical connector to position the latch lock with respect to the housing.

20. The latch lock of claim 13, wherein the base includes an inner surface and an outer surface, the outer surface being angled with respect to the inner surface such that the outer surface is non-parallel with respect to the inner surface defining a wedge portion of the base, the base being configured to be coupled to the housing such that the inner surface engages the housing and the outer surface engages the latch.

* * * * *